US006562087B1

(12) United States Patent
Kodama et al.

(10) Patent No.: US 6,562,087 B1
(45) Date of Patent: May 13, 2003

(54) AUTOMATICALLY IGNITABLE ENHANCER AGENT COMPOSITION

(75) Inventors: Ryoi Kodama, Himeji (JP); Kenjiro Ikeda, Himeji (JP); Yasushi Matsumura, Himeji (JP); Eishi Sato, Himeji (JP); Dairi Kubo, Himeji (JP)

(73) Assignee: Nippon Kayaku Kabushiki-Kaisha, Tokyo (JP)

( * ) Notice: Subject to any disclaimer, the term of this patent is extended or adjusted under 35 U.S.C. 154(b) by 0 days.

(21) Appl. No.: 09/926,815

(22) PCT Filed: Jul. 7, 2000

(86) PCT No.: PCT/JP00/04536

§ 371 (c)(1),
(2), (4) Date: Dec. 21, 2001

(87) PCT Pub. No.: WO01/04074

PCT Pub. Date: Jan. 18, 2001

(30) Foreign Application Priority Data

Jul. 9, 1999 (JP) ..... 11-195810

(51) Int. Cl.[7] ..... C10L 5/00; C06B 31/00; C06B 31/02

(52) U.S. Cl. ..... 44/628; 149/22; 149/45; 149/61

(58) Field of Search ..... 252/186.1, 186.24; 149/22, 45, 61, 108.2; 44/628

(56) References Cited

U.S. PATENT DOCUMENTS

| | | | | |
|---|---|---|---|---|
| 5,084,118 A | | 1/1992 | Poole | |
| 5,565,710 A | | 10/1996 | Ochi et al. | |
| 5,959,242 A | * | 9/1999 | Knowlton | 149/38 |
| 6,101,947 A | * | 8/2000 | Knowlton | 102/288 |
| 6,177,028 B1 | * | 1/2001 | Kanda | 252/186.2 |
| 6,221,187 B1 | * | 4/2001 | Knowlton | 149/38 |
| 6,287,400 B1 | * | 9/2001 | Burns | 149/36 |

FOREIGN PATENT DOCUMENTS

| | | | |
|---|---|---|---|
| EP | 764621 | | 3/1997 |
| JP | 11-157978 | | 6/1999 |
| WO | 96/19422 | | 6/1996 |
| WO | 96/26169 | | 8/1996 |
| WO | 9908983 | * | 2/1999 |

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

An automatically ignitable enhancer agent composition comprising: (a) 5-aminotetrazole, (b) a metal powder, (c) at least one compound selected from the group consisting of potassium nitrate, sodium nitrate and strontium nitrate, and (d) molybdenum trioxide, and having a heating value of 4500 J/g or more. Further, the above composition which has an ability to generate gases in an amount of 0.5 mol to 2.0 mol per 100 g of the composition is also disclosed.

6 Claims, 2 Drawing Sheets

TABLE 1

| Composition | Calorific Value (J/g) | Ignition Time at 200°C (sec.) | t1 of 60 liter tank test (ms) |
|---|---|---|---|
| Example 1 | 4800 | 3.0 | 3.5 |
| Example 2 | 6300 | 5.0 | 2.9 |
| Example 3 | 6550 | 8.0 | 2.8 |
| Comparative Example 1 | 6700 | did not ignite within 180 seconds | 2.8 |
| Comparative Example 2 | 3400 | 3.0 | 8.5 |
| Comparative Example 3 | 3500 | 7.0 | 7.3 |

AUTOMATICALLY IGNITABLE ENHANCER AGENT COMPOSITION

TECHNICAL FIELD

The present invention relates to a novel explosive composition useable as an enhancer agent (transfer charge) for use in a gas generator for an automobile airbag system. The explosive composition of the present invention is characterized in that it has an automatic ignitability, while maintaining a high calorific value.

BACKGROUND ART

An airbag system is a occupant restraint system s which has been widely adopted in recent years to improve safety of occupants in an automobile. The airbag system operates on the principle that a gas generator is operated under control of signals from sensors detecting a collision, to inflate an airbag so as to cushion the shock of the occupants from the collision.

The gas generator is operated through the order that the igniter is ignited when it receives the signals from the sensors, first, and then the ignition is transferred to the enhancer agent to make the gas generants ignite.

The enhancer agents serve to ignite the entire gas generant within a fixed time. This permits the gas generator to exert its full performance without any ignition lag as calculated.

Among the existing enhancer agents, the so-called "$BKNO_3$" containing boron and potassium nitrate as main components is in general use as the enhancer agent. This enhancer agent is in heavy useful in terms of the advantages that it can ignite in a moment of time and also generates high calorific values and that it generates metal thermo-particles of boron to accelerate the ignition. It has the disadvantage, however, that the number of moles of the generated gas is 0.4 or less per 100 g of the $BKNO_3$, so that when this enhancer agent is used for a gas generant of poor ignitability, a reduced amount of gas is generated, and as such can cause unstable ignition.

On the other hand, for the purpose of weight saving of the gas generator, aluminum is now in widespread use as a container material of the gas generator, instead of stainless steel (SUS). The conventional container made of SUS is excellent in strength in high temperature, so that even when a temperature rise is caused by car fire, incineration of the gas generator and the like, the gas generant in the gas generator can be allowed to burn without any fracture of the container.

However, the container of the gas generator made of aluminum is significantly lower in strength in high temperature. When the gas generator made of aluminum is exposed to flame of the car fire and the like and the gas generants filled therein are burnt, if reduction in strength of the aluminum container itself is caused by the flame, then the container cannot withstand the burning pressure of the gas generants and thus can be burst. As a result of this, there is a possible fear that the fragments of the burst container may be flied off to the surrounding to injure the occupants and persons around them.

There have been proposed the countermeasures against the possible burst of the aluminum container, according to which an explosive composition that can ignite automatically at a temperature lower than the temperature at which reduction of strength of aluminum is caused is arranged in the aluminum container, in addition to the gas generant and the enhancer agent, so that the gas generant in the aluminum container is allowed to burn out before the reduction of strength of the aluminum container is caused, to avoid possible dangers of burst of the aluminum container and the like. It should be noted that the automatic ignitability of the automatically ignitable explosives means that the explosive can ignite within the range between 180° C. and 210° C. which is lower than the temperature at which the reduction of strength in high temperature of aluminum is caused.

For example, U.S. Pat. No. 4,561,657 proposed a system for an aluminum container wherein the explosive that can ignite automatically at a temperature lower than the temperature at which reduction of strength of aluminum is caused is arranged in close contact with an inner surface of the container. The automatically ignitable explosive used in this prior art uses nitrocellulose as a major component. Nitrocellulose itself lacks long-term stabilization under high temperature and, what is even worse, there is the possibility that it may spontaneously fire due to the deterioration. For this reason, it is necessary to use an additional automatically ignitable explosive composition, in addition to the gas generant and the enhancer agent. Thus, from the viewpoint of cost also, it is hard to say that the proposed system is of advantageous.

Further, Japanese Laid-open (Unexamined) Patent Publication No. Hei 4(1992)-265289, No. Hei 7(1995)-232989, No. Hei 8(1996)-508972 and No. Hei 8(1996)-511233 disclose automatically ignitable compositions, which however require that some structure therefor be provided in the interior of the gas generator or must be incorporated in the igniting charge or enhancer agent of the igniter, as is the case with the above-noted U.S. Patent. Thus, these prior arts have the disadvantages that the structure is complicated and that the cost is increased.

Republished Patent No. WO97/20786 discloses the enhancer agent having the automatic ignitability. However, this enhancer agent has the calorific value of 3,400 J/g which is lower than the calorific value of 6,700 J/g of $BKNO_3$ and also includes little metal thermo-particles. Therefore, the enhancer agent of this prior art has the disadvantages that there is the possibility that an ignition lag of the gas generator and thus an output failure may be caused.

The conventional enhancer of $BKNO_3$ has an ignition point of about 470° C., around which the function of automatic ignitability defined herein is not provided, however.

In the light of the disadvantages mentioned above, the present invention has been made. It is the object of the present invention to provide the enhancer agent composition having automatic ignitability as well as a high calorific value.

DISCLOSURE OF THE INVENTION

The inventors have been devoted themselves to consider possible ways of solving the problems above and found that by defining the composition of the enhancer agent, the automatic ignitability of the enhancer was developed and also the high calorific value was produced, to thereby produce improved ignition of the gas generant. Deriving from the above, the inventors have accomplished the present invention.

From the examination of the probability of successful ignition of the gas generant resulting from the enhancer agent, it is found that it is preferable that the enhancer agent has the following characteristics i to iii. The present invention has been made on the basis of the understanding that the present invention is directed to an explosive composition that is fundamentally different in idea from the gas generant that seeks for a low calorific value and an increased amount of generated gas in this sense. Although it is ideal that the enhancer agent composition has all characteristic features i through iii listed below, it can function as the enhancer agent by the characteristic feature i only.

Required Characteristic Features for an Enhancer Agent i. The enhancer agent composition has a high calorific value for supplying a sufficient calorific value to the gas generant for successful ignition of the gas gene rant;

ii. The enhancer agent composition has the required number of moles of the generated gas for generating an adequate gas flow to ignite the whole area of each individual gas generant; and iii. The enhancer agent composition has lots of metal thermo-particles to adhere directly to the gas generant to ignite it In other words, the auto-ignition enhancer composition of the present invention is characterized in that it comprises the following components and having a heating value of 4,500 J/g or more, or preferably 6,000 J/g or more:

(a) 5-aminotetrazole, (b) a metal powder, (c) at least one compound selected from the group consisting of potassium nitrate, sodium nitrate and strontium nitrate, and (d) molybdenum trioxide.

The auto-ignition enhancer composition of the present invention provides the automatically ignitability by adding an oxidizing agent, such as potassium nitrate, sodium nitrate, and strontium nitrate, and molybdenum trioxide, in addition to 5-aminotetrazole and the metal powder. It should be noted here that the automatic ignitability means that the ignition takes place in the range of between 180° C. and 210° C. It can be said that this is a necessary temperature range from the viewpoint of the reduction of strength of aluminum in high temperature.

Since the auto-ignition enhancer composition of the present invention has a high calorific value of not less than 4,500 J/g, as well as the automatic ignitability, it has a suitable property as the enhancer agent composition. Particularly, the auto-ignition enhancer composition having a calorific value of 6,000 J/g or more is optimum as the enhancer agent composition.

As a result of this, the auto-ignition enhancer composition of the present invention can provide the automatic ignitability for the gas generator without complicating the structure of the gas generator.

Further, the auto-ignition enhancer composition of the present invention is characterized by combination of the feature above with the feature that the number of moles of the generated gas is in the range of 0.5 or more to 2.0 or less per 100 g of the ignitable enhancer agent composition. When the number of moles of the generated gas is in the range of 0.5 or more to 2.0 or less per 100 g of the enhancer agent composition, the gas flow suitable in amount for igniting the gas generants can be supplied thereto.

The auto-ignition enhancer composition of the present invention can obtain a well stabilized ignition performance by combining the high calorific value and the properly generated gas flow in a balanced manner. As a result of this, the auto-ignition enhancer composition of the present invention can develop the automatic ignitability, while keeping its superior inflammation to that of a general $BKNO_3$ enhancer agent.

Though the metal powder that may be used include a powdered metal alloy, it is preferable that the metal powder is at least one material selected from the group consisting of aluminum, magnesium, magnalium, boron, titanium, and zirconium.

Specifically, when boron is selected for the metal powder, the auto-ignition enhancer composition of the present invention preferably has the following composition ratio I, or further preferably the composition ratio II:

I. (a) 5-aminotetrazole: 3 weight % or more to 25 weight % or less, (b) boron: 5 weight % or more to 30 weight % or less, (c) potassium nitrate: 50 weight % or more to 85 weight % or less, and (d) molybdenum trioxide: 0.2 weight % or more to 10 weight % or less;

or

II. (a) 5-aminotetrazole: 5 weight % or more to 15 weight % or less, (b) boron: 16 weight % or more to 25 weight % or less, (c) potassium nitrate: 60 weight % or more to 80 weight % or less, and (d) molybdenum trioxide: 1 weight % or more to 7 weight % or less.

This auto-ignition enhancer composition of the present invention contains a small amount of nitrogen-containing organic compound, i.e., 5-aminotetrazole, of 25 weigh %, or preferably 15 weight %, and a large amount of metal powder within the range between 5 weigh % and 30 weight %, or preferably between 16 weight % and 25 weight %. This can allow the gas generants to be ignited directly by a lot of metal thermo-particles, thus providing little temperature dependency and stable ignitable performance.

BEST MODE FOR CARRYING OUT THE INVENTION

Figure 1:
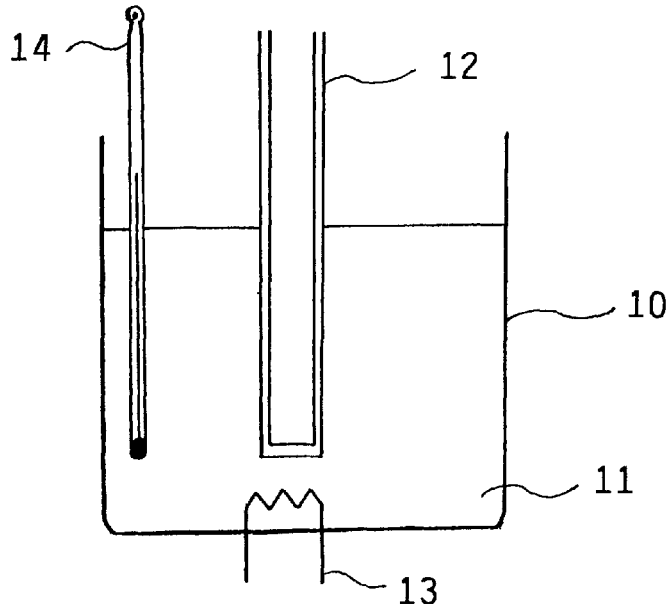
FIG. 1 is an illustration of the ignition delay test equipment used in Examples and Comparative Examples.

An auto-ignition enhancer composition of the present invention comprises the following components and has a heating value of 4,500 J/g or more, or preferably 6,000 J/g or more:

(a) 5-aminotetrazole, (b) a metal powder, (c) at least one compound selected from the group consisting of potassium nitrate, sodium nitrate and strontium nitrate, and (d) molybdenum trioxide.

It is preferable that the automatic ignitable enhancer composition of the present invention has an ability to generate gas in the number of moles of between 0.5 mol and 2.0 mol per 100 g of the composition.

The 5-aminotetrazole is contained as the fuel component. Of nitrogen-containing organic compounds, 5-aminotetrazole is a desirable component for the present invention in that it is very easy to handle, including thermal stability and safety, and is low in price. A 5-aminotetrazole content is preferably in the range of between 3 weight % and 25 weight %, or preferably between 5 weight % and 15 weight %. It is enough to contain a minimum amount of 5-aminotetrazole required for the automatic ignitability. With a 5-aminotetrazole content of more than 25 weight %, reduction of the calorific value of the enhancer agent composition and reduction of the metal thermo-particle or lack of transfer of charge are caused. With a 5-aminotetrazole content of less than 3 weight %, the automatic ignitability does not develop undesirably.

At least one component selected from the group consisting of potassium nitrate, sodium nitrate and strontium nitrate is contained as the oxidizing agent. Other nitrate salts are not desirable in that they do not develop the automatic ignitability when used singularly. But, when used combination with the at least one component selected from the group consisting of potassium nitrate, sodium nitrate and strontium nitrate, they can develop the automatic ignitability. Potassium nitrate is particularly preferable in that it does not have the moisture-absorption characteristics and is easy to handle. An oxidizing agent content is preferably in the range of between 50 weight % and 85 weight %, or preferably between 60 weight % and 80 weight %. With an oxidizing agent content of less than 50 weight %, an amount of oxygen supplied runs short, so that incomplete combustion is caused and a harmful CO gas is produced. With an oxidizing agent content of more than 85 weight %, the calorific value reduces and the inflammation power runs short.

Concrete examples of the metal powder are aluminum, magnesium, magnalium, boron, titanium and zirconium. Boron is particularly preferable from the viewpoints of low danger in handling and low cost. As a metal powder content increases, the calorific value increases and the, metal thermo-particle increases. The metal powder is required to have a value of 4,500 J/g or more, or preferably 6,000 J/g or more to operate the gas generator without problems. Therefore, it is preferable that a metal powder content is in the range of between 5 weight % and 30 weight %, or preferably between 16 weight % and 25 weight %. With a metal powder content of less than 5 weight %, reduction of the calorific value and reduction of the metal thermo-particle are caused. With a metal powder content of more than 30 weight %, amounts of other components are reduced on the whole, so that the automatic ignitability is no longer developed.

A molybdenum trioxide content is preferably in the range of between 0.2 weight % and 10 weight %, or preferably between 1 weight % and 7 weight %. It is enough to contain a minimum amount of molybdenum trioxide required for the automatic ignitability. With a molybdenum trioxide content of less than 0.2 weight %, the automatic ignitability does not develop. When a more than 10 weight % of molybdenum trioxide is added, significant reduction of the calorific value is caused.

When the number of moles of the gas generated by the auto-ignition enhancer composition of the present invention is less than 0.5, a reduced generated gas flow is provided, so that there is the possibility that an unstable ignition may be caused. On the other hand, when the number of moles of the generated gas is more than 2.0, the calorific value is reduced, so that there is the possibility that the composition may not fully exert its performance as the enhancer.

Various kinds of additives may be added to the enhancer agent composition of the present invention, if desired. The additives that may be used include a binder, an anti-caking agent, and an auxiliary agent for molding. The binders that may be used include, for example, hydrotalcites and nitrocellulose. The anti-caking agents that may be used include, for example, silicon nitride and silicon carbide. The auxiliary agents that may be used include, for example, magnesium stearate and zinc stearate. It is preferable that a content of the additive to the enhancer agent composition of the present invention is in the range of between 0.1 weight % and 5 weight %.

Now, reference will be given to a preferable combination of the components of the enhancer agent composition of the present invention. Boron is most preferable as the metal powder, and potassium nitrate is most preferable as the oxidizing agent.

Preferably, the components of the enhancer agent composition of the present invention comprise 3–25 weight % of 5-aminotetrazole, 5–30 weight % of boron, 50–85 weight % of potassium nitrate and 0.2–10 weight % of molybdenum trioxide.

Further preferably, the components of the enhancer agent composition of the present invention comprise 5–15 weight % of 5-aminotetrazole, 16–25 weight % of boron, 60–80 weight % of potassium nitrate, and 1–7 weight % of molybdenum trioxide.

The components are adjusted within such a composition ratio so that the calorific value of 4,500 J/g or more, or preferably 6,000 J/g or more, can be produced. It should be noted that the calorific value should be limited to not more than 7,500 J/g from the heat-resistance of the aluminum container, although a possible highest calorific value is desirable from the viewpoint of ignitability.

The auto-ignition enhancer composition of the present invention may selectively be formed into a powdery form, a granular form or a pellet form. Alternatively, the mixed agents -may be provided in the form of cast articles or extruded products. It may selectively be-formed into a pellet form, a single-hole or a multi-hole (porous) tubular form, for example.

Next, reference will be given to the manufacturing method of the enhancer agent composition of the present invention. The auto-ignition enhancer composition of the present invention can -be manufactured in either method of the press molding and the extrusion molding. After having been molded, the auto-ignition enhancer composition is heat-treated to be fully dried out, so as to prevent an ignition lag caused by the moisture and provide an improved environmental resistance.

When the enhancer agent composition is molded by the press molding, the anti-caking agent is added to the fuel components and the oxidizing agent, first. Then, the respective components are mixed with a V-type blending machine and then are pulverized. After a prescribed quantity of pulverized fuel components, pulverized oxidizing agent and auxiliary agent for molding are taken by measurement, they are mixed equally with the V-type blending machine. Thereafter, they are put into the press molding machine and then heat-treated. The molded products thus obtained are used as the enhancer agent composition.

Likewise, when the enhancer agent composition is molded by the extrusion molding, the fuel components and the oxidizing agent are pulverized, first. Then, after the respective components are taken into a spiral mixer by measurement and 8–25 weight % water in outer percentage is added thereto, they are fully kneaded to produce moist agents having viscosity. Thereafter, they are formed into a desired form and cut properly by use of a vacuum kneading extrusion machine and then are subjected to heat treatment. The molded products thus obtained are used as the enhancer agent composition.

Then, reference will be given to particle diameter of the components used for the enhancer agent composition of the present invention. Preferably, the components have the following particle diameters in terms of a 50% particle diameter. 5-aminotetrazole: 1 μm or more to 30 μm or less, potassium nitrate: 20 μm or more to 100 μm or less, boron: 0.5 μm or more to 20 μm or less, and molybdenum trioxide: 1 μm or more to 40 μm or less.

Further preferably, the components have the following particle diameters in terms of the 50% particle diameter. 5-aminotetrazole: 10 μm or more to 20 μm or less, potassium nitrate: 40 μm or more to 70 μm or less, boron: 1 μm or more to 15 μm or less, and molybdenum trioxide: 5 μm or more to 25 μm or less.

Measurement Tests

The measuring tests were performed to examine the following points of the auto-ignition enhancer composition of the present invention.

Measurement of Calorific Value

The measurement of the calorific value was made by use of a bomb calorimeter. 1.0 g of auto-ignition enhancer composition of the present invention was taken by measurement and put in an airtight container made of SUS. Thereafter, the container was covered with its sealed lid in the condition in which a heating element was put in contact with the enhancer agent composition. Then, after the container was sunk in a thermal insulation vessel filled with water, the heating element was energized to make the enhancer agent composition in the container burn completely. The calorific value was calculated from the temperature rise of the water and the specific heat.

Ignition Lag Test

The ignition lag test was performed as follows, to examine the automatic ignitability of the auto-ignition enhancer composition of the present invention. An oil bath 10 with an automatic temperature controller shown in FIG. 1 was filled with silicon oil 11 and further an iron tube 12 having an internal diameter of 2 cm and a length of 20 cm was set therein. Then, the oil bath was kept at 200° C. by use of a heater 13 and a thermometer 14. The time required for 0.2 g of the auto-ignition enhancer composition of the present invention to ignite or produce a noise of ignition after it was put in the iron tube 12 was measured. When a test sample was confirmed to ignite or make a noise of ignition within one minute, that test sample was defined as having the automatic ignitability.

60 Liter Tank Test

Figure 2:
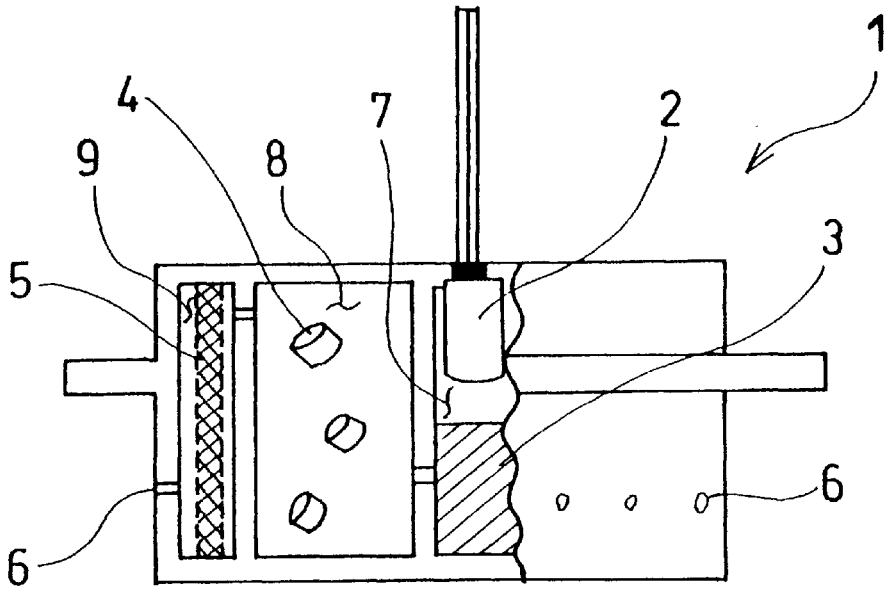
FIG. 2 is a schematic sectional view of a principal structural part of the gas generator used in Examples and Comparative Examples.
Figures 3, 4:
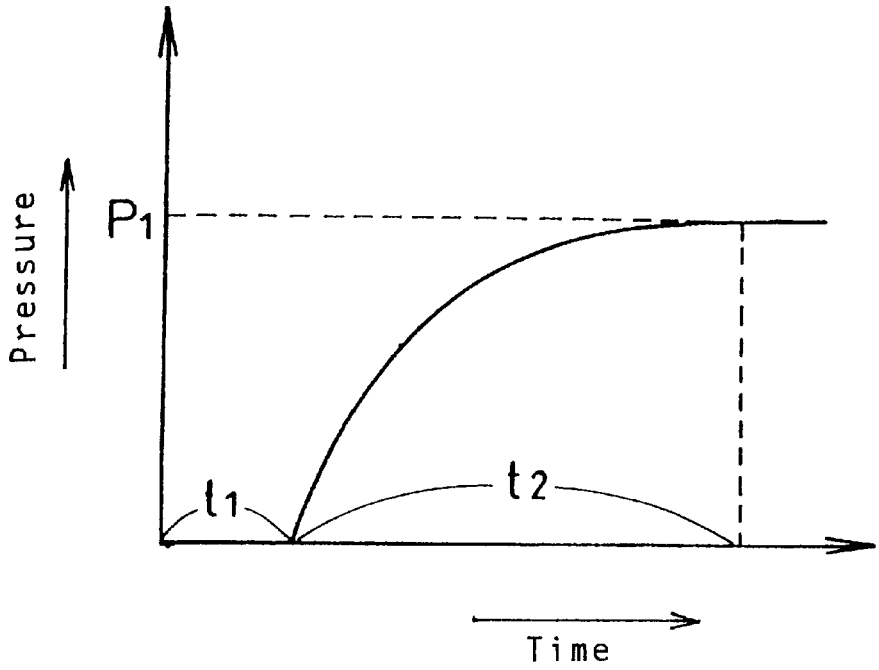
FIG. 3 is a graph illustrating the combustion in the 60 liter tank test obtained by the operation of the gas generator using the auto-ignition enhancer composition of the present invention, wherein the pressure is plotted against the time.
FIG. 4 is a TABLE 1 showing the measurement test results.

A 60 liter tank test was performed by use of the gas generator 1 shown in FIG. 2, to examine the ignitability of the enhancer agent composition to the gas generant. The gas generator 1 comprises a central igniting chamber 7 in which an igniter 2 and a transfer charge 3 are arranged, a combustion chamber 8 which is located around the central igniting chamber and in which gas generants 4 are packed, and a cooling/filtering chamber 9 which is located around the combustion chamber and in which a woven metal wire 5 is disposed. After having been mounted to a container having an internal volume of 60 liter, the gas generator 1 was operated to make the measurement of the pressure in the container. As shown in FIG. 3, P1 represents a maximum ultimate pressure, t1 represents the time that elapsed from the application of power to the igniter 2 to the operation of the gas generator 1, and t2 represents the time that elapsed before the pressure 1 was obtained after the operation of the gas generator 1. The enhancer agent composition is demanded to have the ignition performance that the time t1 is within 4 ms. When the time t1 exceeds this time range, the ignition lag is caused in the gas generator 1, such that it does not exert its full performance. Shown herein is the time t1 that elapsed from the application of power to the igniter 2 to the operation of the gas generator 1.

The gas generants 4 in the gas generator 1 used in the 60 liter tank test were prepared in the manner as mentioned below.

5-aminotetrazole and guanidine nitrate used as the fuel components, strontium nitrate used as the oxidizing agent component, silicon nitride used as the slag forming agent, and a synthetic hydrotalcite used as the binder were prepared at the composition ratio given below.

- 5-aminotetrazole (15 μm in 50% particle diameter): 24.7 parts by weight
- Guanidine nitrate (30 μm in 50% particle diameter): 11.9 parts by weight
- Strontium nitrate (13 μm in 50% particle diameter): 53.4 parts by weight
- Silicon nitride (5 μm in 50% particle diameter): 5.0 parts by weight
- Synthetic hydrotalcite (10 μm in 50% particle diameter): 5.0 parts by weight The components were dry blended by use of the V-type blending machine. Then, 15 parts of weight of water to the total quantity of mixed powders was sprayed on the powders under stirring. Thereafter, they were subjected to the wet granulation process to produce granulated powders of not more than 1 mm in particle diameter. After the granulated powders thus produced were dried by heating, they were pressed into shapes by the rotary pelletizing machine to produce pellets of 5 mm in diameter and 1.5 mm in height of the gas generant. 40 g of the pellets were packed in the gas generator 1 shown in FIG. 2, for the use of the 60 liter tank test.

PREPARATION OF TEST SAMPLES

Example 1

The components were prepared at the following composition ratio given below.

- 5-aminotetrazole (15 μm in 50% particle diameter): 19.5 parts by weight
- Fine powder of boron (9 μm in 50% particle diameter): 8.0 parts by weight
- Molybdenum trioxide (17 μm in 50% particle diameter): 8.0 parts by weight
- Potassium nitrate (60 μm in 50% particle diameter): 64.5 parts by weight
- Isoamyl acetate solution of nitrocellulose: 50.0 parts by weight
  (Concentration: 2 weight %) (1 part by weight in terms of nitrocellulose)

The 5-aminotetrazole, the fine powder of boron, and the molybdenum trioxide were dry blended by use of a V-type blending machine. Then, the isoamyl acetate solution of nitrocellulose was added and the mixture was further mixed in a mortar until it was slurried. The potassium nitrate was added to the slurry and further mixed until a homogeneous mixture was obtained. Thereafter, the isoamyl acetate was evaporated from the mixture and then the mixture was made to pass through a 1 mm mesh to thereby produce the granulated powders. The granulated powders thus produced were dried at 110° C. for 5 hours to produce the auto-ignition enhancer composition of the present invention.

The measurement results of the above-mentioned tests using this test sample were shown in TABLE 1 of FIG. 4.

Example 2

The components were prepared at the following composition ratio given below.

5-aminotetrazole (15 μm in 50% particle diameter): 11.2 parts by weight

Fine powder of boron (9 μm in 50% particle diameter): 16.2 parts by weight

Molybdenum trioxide (17 μm in 50% particle diameter): 3.0 parts by weight

Isoamyl acetate solution of nitrocellulose: 50.0 parts by weight
(Concentration: 2 weight %) (1 part by weight in terms of nitrocellulose)

Potassium nitrate (60 μm in 50% particle diameter): 69.6 parts by weight

The 5-aminotetrazole, the fine powder of boron, and the molybdenum trioxide were dry blended by use of the V-type blending machine. Then, the isoamyl acetate solution of nitrocellulose was added and the mixture was further mixed in the mortor until it was slurried. The potassium nitrate was added to the slurry and further mixed until a homogeneous mixture was obtained. Thereafter, the isoamyl acetate was evaporated from the mixture and then the mixture was made to pass through the 1 mm mesh to thereby produce the granulated powders. The granulated powders thus produced were dried at 110° C. for 5 hours to produce the auto-ignition enhancer composition of the present invention.

The measurement results of the above-mentioned tests using this test sample were shown in TABLE 1 of FIG. 4.

Example 3

The components were prepared at the following composition ratio given below.

5-aminotetrazole (15 μm in 50% particle diameter): 8.5 parts by weight

Fine powder of boron (9 μm in 50% particle diameter): 18.7 parts by weight

Molybdenum trioxide (17 μm in 50% particle diameter): 1.5 parts by weight

Isoamyl acetate solution of nitrocellulose: 50.0 parts by weight
(Concentration: 2 weight %) (1 part by weight in terms of nitrocellulose)

Potassium nitrate (60 μm in 50% particle diameter): 71.3 parts by weight

The 5-aminotetrazole, the fine powder of boron, and the molybdenum trioxide were dry 6 blended by use of the V-type blending machine. Then, the isoamyl acetate solution of nitrocellulose was added and the mixture was further mixed in the mortor until it was slurried. The potassium nitrate was added to the slurry and further mixed until a homogeneous mixture was obtained. Thereafter, the isoamyl acetate was evaporated from the mixture and then the mixture was made to pass through the 1 mm mesh to thereby produce the granulated powders. The granulated powders thus produced were dried at 110° C. for 5 hours to produce the auto-ignition enhancer composition of the present invention.

The measurement results of the above-mentioned tests using this test sample were shown in TABLE 1 of FIG. 4.

Comparative Example 1

The $BKNO_3$ generally used as the enhancer agent component was prepared in the following procedures.

The components were prepared at the following composition ratio given below.

| | |
|---|---|
| Fine powder of boron: | 25.0 parts by weight |
| Potassium nitrate: | 75.0 parts by weight |
| Isoamyl acetate solution of nitrocellulose: | 50.0 parts by weight |

(Concentration: 2 Weight %) (1 Part by Weight in Terms of Nitrocellulose)

The isoamyl acetate solution of nitrocellulose was added to the fine powder of boron and the potassium nitride and was further mixed in the mortar until it was slurried. Thereafter, the isoamyl acetate was evaporated from the mixture and then the mixture was made to pass through a 1 mm mesh to thereby produce the granulated powders. After the granulated powders thus produced were dried at 110° C. for 5 hours to produce the $BKNO_3$ enhancer agent composition.

The measurement results of the above-mentioned tests using this test sample were shown in TABLE 1 of FIG. 4.

Comparative Example 2

The automatically ignitable composition disclosed as Example 1 by Republished Patent No. WO97/20786 was prepared as Comparative Example 2 in the following procedures.

The components were prepared at the following composition ratio given below.

| | |
|---|---|
| 5-aminotetrazole: | 34.2 parts by weight |
| Potassium nitrate: | 56.8 parts by weight |
| Molybdenum trioxide: | 4.5 parts by weight |
| Synthetic hydrotalcite: | 4.5 parts by weight |

The 5-aminotetrazole, the potassium nitrate, the molybdenum trioxide, and the synthetic hydrotalcite were dry blended by use of the V-type blending machine. Then, water was added as solvent and the mixture was subjected to the wet granulation process and was made to pass through the 1 mm mesh to thereby produce the granulated powders. The granulated powders thus produced were dried at 110° C. for 5 hours to produce the automatically ignitable composition.

The measurement results of the above-mentioned tests using this test sample were shown in TABLE 1 of FIG. 4.

Comparative Example 3

The automatically ignitable composition disclosed by Japanese Laid-open (Unexamined) Patent Publication No. Hei 7(1995)-232989 was prepared as Comparative Example 3 in the following procedures.

The components were prepared at the following composition ratio given below.

| | |
|---|---|
| Saccharose: | 23.0 parts by weight |
| Potassium chlorate: | 74.0 parts by weight |
| Magnesium oxide: | 2.0 parts by weight |

The saccharose, the potassium chlorate and the magnesium oxide were dry blended by use of the V-type blending machine. Then, silicon resin was added thereto and kneaded. The mixture was made to pass through the 1 mm mesh to thereby produce the granulated powders. The granulated powders thus produced were allowed to stand for 48 hours, so as to be cured to thereby produce the automatically ignitable composition.

The measurement results of the above-mentioned tests using this test sample were shown in TABLE 1 of FIG. 4.

Results

It can be seen from TABLE 1 of FIG. 4 that the $BKNO_3$ that have been heavily used so far (Comparative Example 1) did not ignite even after 180 seconds passed and did not provide the automatic ignitability in the ignition time at 200° C. Although the composition disclosed by the Republished Patent No. WO97/20786 (Comparative Example 2) and the composition disclosed by Japanese Laid-open (Unexamined) Patent Publication No. Hei 7(1995)-232989 (Comparative Example 3) have the automatic ignitability, since the calorific values are not more than 4,500 J/g, the ignition lag of the gas generator is caused. Hence, these compositions do not fulfill the required performance of the gas generator. It is to be noted that in the 60 liter tank test, the required value t1 of the gas generator is not more than 4 ms.

In contrast to this, the automatic ignitable enhancer agent compositions of the present invention (Examples 1 through 3) have the calorific values of 4,500 J/g or more, while also they have the automatic ignitability, and consequently no ignition lag was observed in the 60 liter tank tests.

Capabilities of Exploitation in Industry

Since the automatic ignitable enhancer agent composition of the present invention has the high calorific value, it is optimum as the enhancer agent composition. Further, the automatic ignitable enhancer agent composition of the present invention is an enhancer agent composition having the automatic ignitability, and as such can allow the gas generator made of aluminum to have the automatic ignitability without complicating the structure of the gas generator made of aluminum.

What is claimed is:

1. An auto-ignition enhancer composition comprising the following components at the following composition ratio and having a heating value of 4,500 J/g or more:

(a) 5-aminotetrazole: 3 weight % or more to 25 weight % or less, (b) boron: 5 weight % or more to 30 weight % or less, (c) potassium nitrate: 50 weight % or more to 85 weight % or less, and (d) molybdenum trioxide: 0.2 weight % or more to 10 weight % or less.

2. An auto-ignition enhancer composition comprising the following components at the following composition ratio and having a heating value of 4,500 J/g or more:

(a) 5-aminotetrazole: 5 weight % or more to 15 weight % or less, (b) boron: 16 weight % or more to 25 weight % or less, (c) potassium nitrate: 60 weight % or more to 80 weight % or less, and (d) molybdenum trioxide: 1 weight % or more to 7 weight % or less.

3. The auto-ignition enhancer composition according to claim 1, wherein the calorific value is 6,000 J/g or more.

4. The auto-ignition enhancer composition according to claim 1, wherein the number of moles of the generated gas is in the range of 0.5 or more to 2.0 or less per 100 g of the auto-ignition enhancer composition.

5. The auto-ignition enhancer composition according to claim 2, wherein the calorific value is 6,000 J/g or more.

6. The auto-ignition enhancer composition of claim 2, wherein the number of moles of the generated gas is in the range of 0.5 or more to 2.0 or less per 100 g of the auto-ignition enhancer composition.

* * * * *